US006030267A

United States Patent [19]

Browning

[11] Patent Number: 6,030,267

[45] Date of Patent: Feb. 29, 2000

[54] ALIGNMENT METHOD FOR FIELD EMISSION AND PLASMA DISPLAYS

[75] Inventor: Jim J. Browning, Boise, Id.

[73] Assignee: Micron Technology, Inc., Boise, Id.

[21] Appl. No.: 09/253,062

[22] Filed: Feb. 19, 1999

[51] Int. Cl.[7] ..... H01J 9/26

[52] U.S. Cl. ..... 445/25; 313/495

[58] Field of Search ..... 445/24, 25; 313/495

[56] References Cited

U.S. PATENT DOCUMENTS 5,788,551 8/1998 Dynka et al. ..... 445/25

5,807,154 9/1998 Watkins ..... 445/25

*Primary Examiner*—Kenneth J. Ramsey

*Attorney, Agent, or Firm*—Dickstein Shapiro Morin & Oshinsky LLP

[57] ABSTRACT

The present invention discloses a method for accurately maintaining an alignment of a faceplate and a cathode member during the manufacturing of field emission displays and plasma displays. The invention maintains the alignment in preparation for, and throughout, the sealing process of these displays through the application of a glass frit material on at least one of the plates. A sol-gel material is further applied on top of the glass frit; and, in addition, for optimum performance, an adhesive material is used in conjunction with the sol-gel material for enhanced support of the plates during the early stages of the sealing process. The adhesive material, which maintains the alignment early in the sealing process, may evaporate or soften as the temperature increases, at which point, the sol-gel material maintains the plates in alignment during the softening of the seal frit.

63 Claims, 15 Drawing Sheets

ALIGNMENT METHOD FOR FIELD EMISSION AND PLASMA DISPLAYS

BACKGROUND OF THE INVENTION

1. Field of the Invention

The present invention relates to the assembly of a faceplate with a baseplate as used in field emission displays ("FEDs") and plasma displays. More specifically, it relates to a process for accurately maintaining an alignment of the faceplate with the baseplate in preparation for, and throughout, the sealing process.

2. Description of the Related Art

A FED, as is well known in the art, is a flat panel display which has a faceplate, on which phosphor pixels reside, and a plurality of micro-tip cathode members spaced a short distance from the faceplate, which emit electrons to activate the phosphors. In some embodiments, each cathode member is attached to, or is integrally formed with, a backplate. In other embodiments, each cathode member is also attached to the faceplate and all of the cathode members are surrounded by a separate backplate.

Similarly, plasma displays, as is well known in the art, are flat panel displays that, in the simplest configuration, consist of two glass plates; each with parallel electrodes deposited on their surfaces. The plates are assembled with their electrodes at right angles, and the gap between the plates is filled with a rare gas mixture. Each pixel at the intersection of a line and a column electrode can be illuminated independently when a voltage pulse is applied between the two electrodes. The voltage pulse leads to the breakdown of the gas and to the formation of a weakly ionized plasma that emits visible or UV light.

For both FEDs and plasma displays, it is necessary to accurately align the faceplate and baseplate of the display and then seal the plates together by melting a high temperature (approximately 500° C.) glass frit seal while the plates are pressed together. In order to achieve this, traditionally, an alignment tool is used to control the x and y positions, and the pitch and roll of the plates relative to each other so they stay aligned during the sealing process.

FIGS. 1–3 depict two conventional methods of achieving the above mentioned frit seal. Referring first to FIG. 1, a backside view of a faceplate 20 is shown. The glass frit 22 is usually placed around all of the edges of either glass plate (i.e., baseplate or faceplate), with FIG. 1 showing the glass frit 22 around the edges of the backside of faceplate 20. Spacers 23 are usually located at spaced apart locations on the faceplate and provide for the necessary final spatial gap between the front and base plates. Since the gap will either be a vacuum or filled with a rare gas mixture, a hole may be left in the seal 22 for purposes of attaching an exhaust tube.

Referring now to FIG. 2(*a*), a side view of a typical sealing structure (as in FIG. 1) is shown. Baseplate 21 is depicted as being in alignment with faceplate 20. Glass frit 22 has been disposed around faceplate 20 and spacers 23*a*, 23*b* provide the inherent gap. After alignment, baseplate 21 is moved in the direction A of faceplate 20 until baseplate 21 is touching the glass frit 22, as seen in FIG. 2(*b*).

When the baseplate 21 makes contact with the glass frit 22, as seen in FIG. 2(*b*), the FIG. 2(*b*) assembly is heated to temperatures upwards of 500° C. until the glass frit 22 begins to soften. With the glass frit 22 softening due to the increased temperature, the plates 20, 21 are moved closer together through the use of clamps until the excess glass frit 22 is extruded slightly between the plates, as depicted in FIG. 2(*c*). During this assembly process, however, there is no way of assuring the plates 20, 21 will remain in accurate alignment, unless some alignment mechanism is employed to maintain alignment.

FIG. 3(*a*) depicts an alternative method for sealing the face and baseplates which is also known in the art and is described in, for example, U.S. Pat. No. 5,807,154, to Watkins, incorporated herein by reference. In this method, baseplate 20 and faceplate 21 are in alignment. Spacers 23*a*, 23*b*, are located at the outer edges of the baseplate 20. Each spacer 23*a*, 23*b* supports a small deposit of an adhesive material 33, and also a small deposit of glass frit 32. When the faceplate 21 is touching the adhesive material 33, the faceplate 21 is relatively stationary and the assembly is ready to be heated. In other words, the adhesive 33 holds plates 20, 21 in an aligned condition. The plates 20, 21 are then pressed further together as the heat is applied until the plates are in the FIG. 3(*b*) sealed configuration.

During the early stages of the sealing process, the adhesive material 33 is removed due to the applied heat, leaving only the glass frit 32 behind to form an hermetic seal between the plates 20, 21. While this method is useful and solves some alignment problems, there is no sure way of maintaining the plates 20, 21 in alignment during the entire assembly process without the use of a mechanical fixture. This is especially true during the initial heating stages in which the adhesive is melted from between the plates. In such a situation, it is not uncommon, absent use of an alignment tool, to have an inadvertent shifting of the plates.

SUMMARY OF THE INVENTION

The present invention provides a method for maintaining an alignment of the faceplate with the baseplate in preparation for, and throughout, the sealing process as practiced in the manufacturing of both field emission and plasma displays. In the present invention, a sol-gel material, such as, for example, xerogel, is applied directly on top of a section of the sealing glass frit, or in the alternative, directly on top of an additional portion of glass frit which is separate from the sealing frit and which has been applied to either the faceplate or the baseplate. The plates are then aligned at or near room temperature.

After alignment, the sol-gel material is allowed to cure for approximately 1 hour at atmospheric pressure at which point it is approximately one-tenth to one-half the density of glass. Thereafter, the assembly is heated, in the usual fashion, to the point at which the glass frit begins to soften. At this point, the plates are squeezed together so as to extrude the glass frit from between the plates; all the while, the sol-gel maintains its glass-like qualities, high density and also maintains an alignment of the plates which is accurate to within less than 5 $\mu$m for a 12 in. diagonal display.

Generally speaking, as it is commonly held in the manufacturing of such displays, it is desirable to align the plates as fast as possible at a low temperature and then send them to the sealing process. Accordingly, in an alternative embodiment of the present invention, a small quantity of an adhesive (e.g., indium) is used in combination with the sol-gel so as to provide a faster alignment process. The adhesive is used to quickly tack the plates together while the plates are being fixtured and while the sol-gel is allowed to cure; thereafter, the sol-gel holds the plates together during the remainder of the sealing process. In addition, as will be described more fully below, the sol-gel material may be mixed so that it cures much faster than 1 hr (e.g., 5 minutes). It may also be heated slightly (50 to 70° C.) or irradiated with IR light to cure it faster.

BRIEF DESCRIPTION OF THE DRAWINGS

These and other advantages and features of the invention will be more clearly understood from the following detailed description of the invention which is provided in connection with the accompanying drawings in which:

FIG. 2(*b*) illustrates the conventional FIG. 2(*a*) faceplate/baseplate alignment after they have been joined together;

FIG. 2(*c*) illustrates the conventional extrusion of excess glass frit from between the plates;

FIG. 3(*b*) illustrates the conventional FIG. 3(*a*) faceplate/baseplate alignment after the plates have been pressed together;

FIG. 5(*b*) illustrates the FIG. 5(*a*) faceplate/baseplate alignment after they have been joined together;

FIG. 5(*c*) illustrates the extrusion of excess glass frit from between the FIG. 5(*b*) faceplate/baseplate during the sealing process;

FIG. 7(*b*) illustrates the FIG. 7(*a*) faceplate/baseplate alignment after they have been joined together;

FIG. 7(*c*) illustrates the extrusion of excess glass frit from between the FIG. 7(*b*) faceplate/baseplate during the sealing process;

DETAILED DESCRIPTION OF PREFERRED EMBODIMENTS

Preferred embodiments of the present invention will now be described with reference to FIGS. 4–9. Other embodiments may be realized and structural, or logical changes may be made to the disclosed embodiments without departing from the spirit or scope of the present invention.

Figure 1:
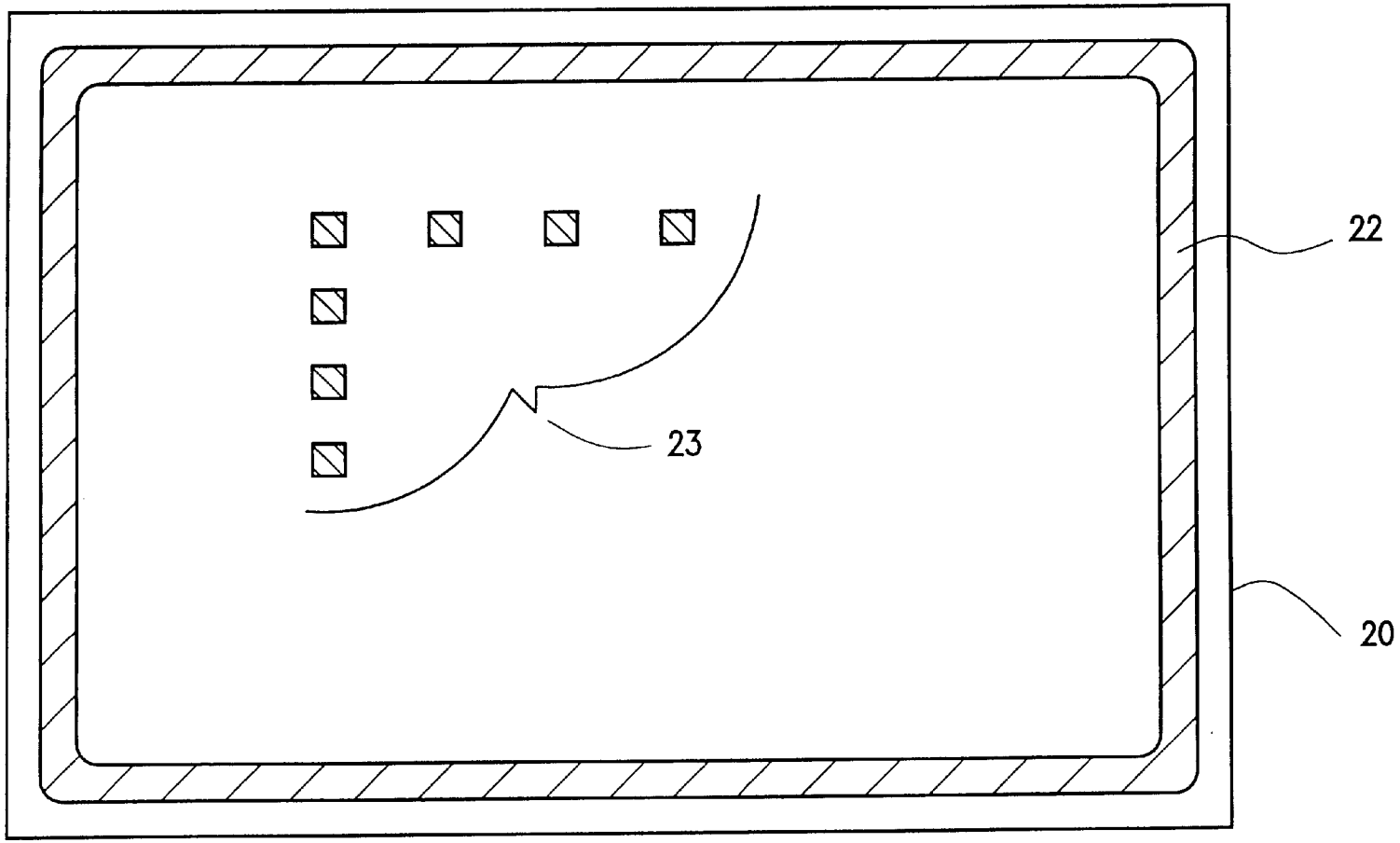
FIG. 1 PRIOR ART
FIG. 1 illustrates a backside view of a conventional faceplate with glass frit disposed around the outer edges in preparation for sealing.
Figure 2A:
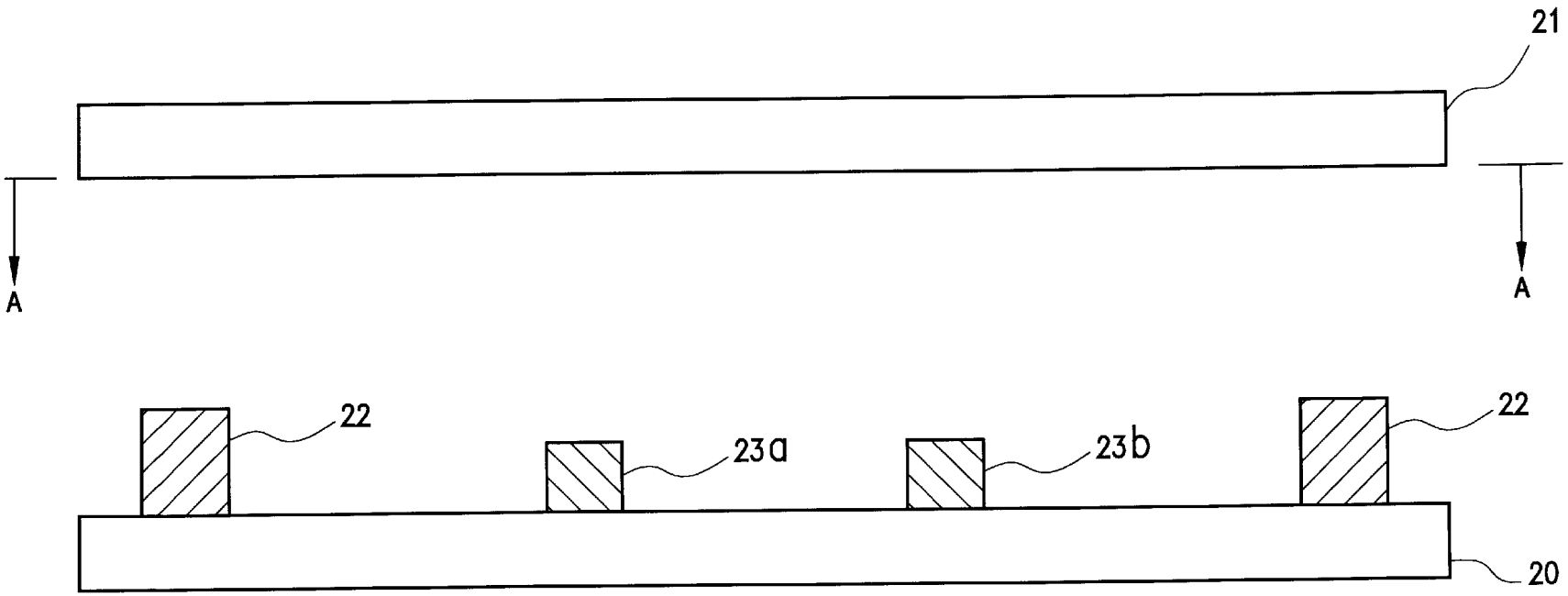
FIG. 2(a) PRIOR ART
FIG. 2(*a*) illustrates a side view of the FIG. 1 faceplate in alignment with a baseplate in preparation for sealing.
Figure 2B:
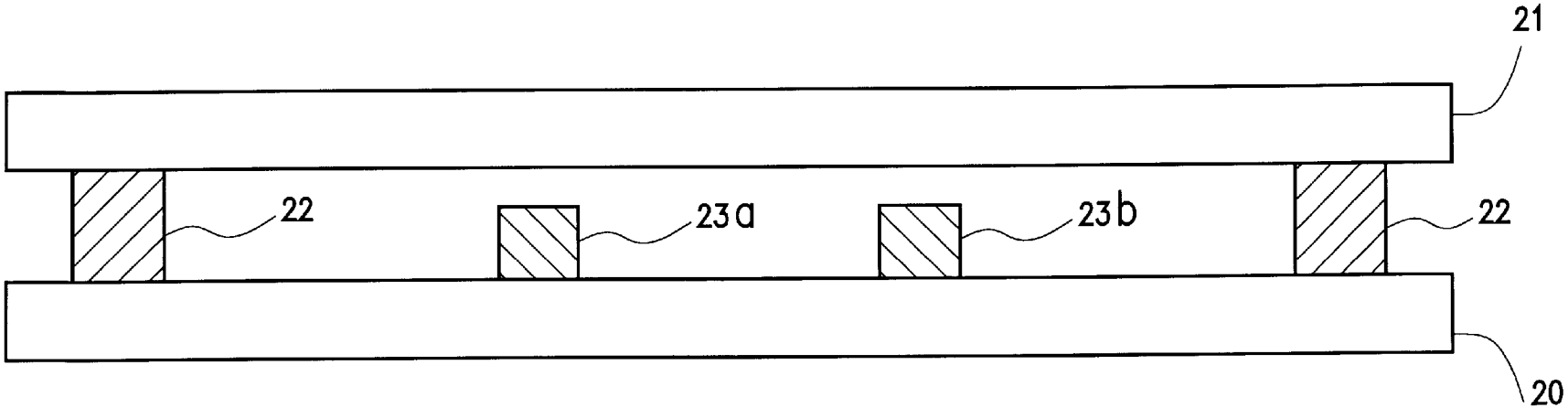
FIG. 2(b) PRIOR ART
Figure 2C:
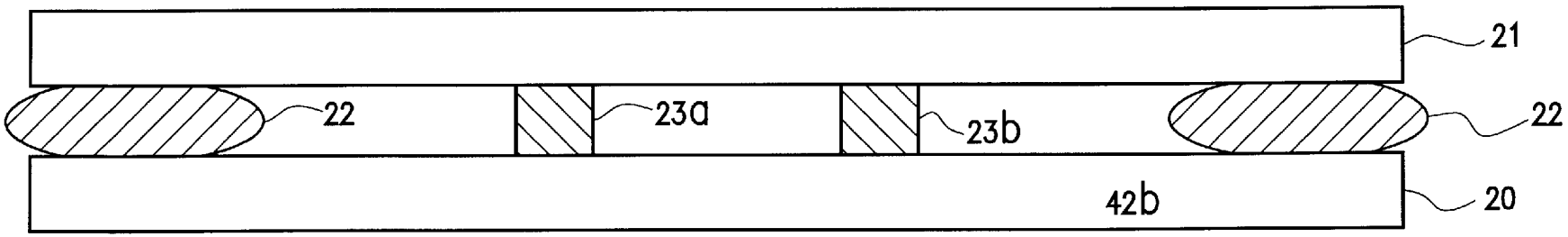
FIG. 2(c) PRIOR ART
Figure 3A:
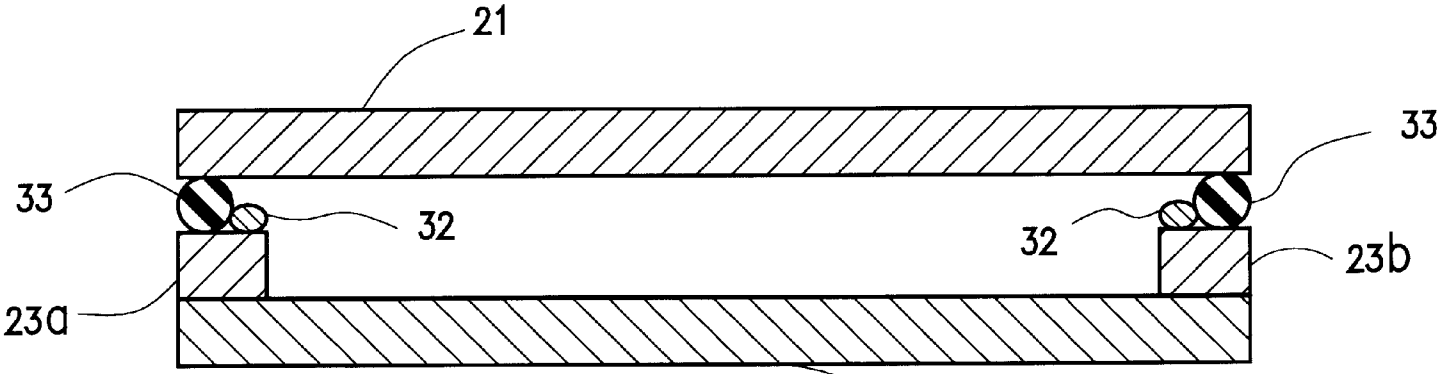
FIG. 3(a) PRIOR ART
FIG. 3(*a*) illustrates a conventional faceplate/baseplate alignment using both adhesive material and glass frit disposed on top of plate spacers.
Figure 3B:
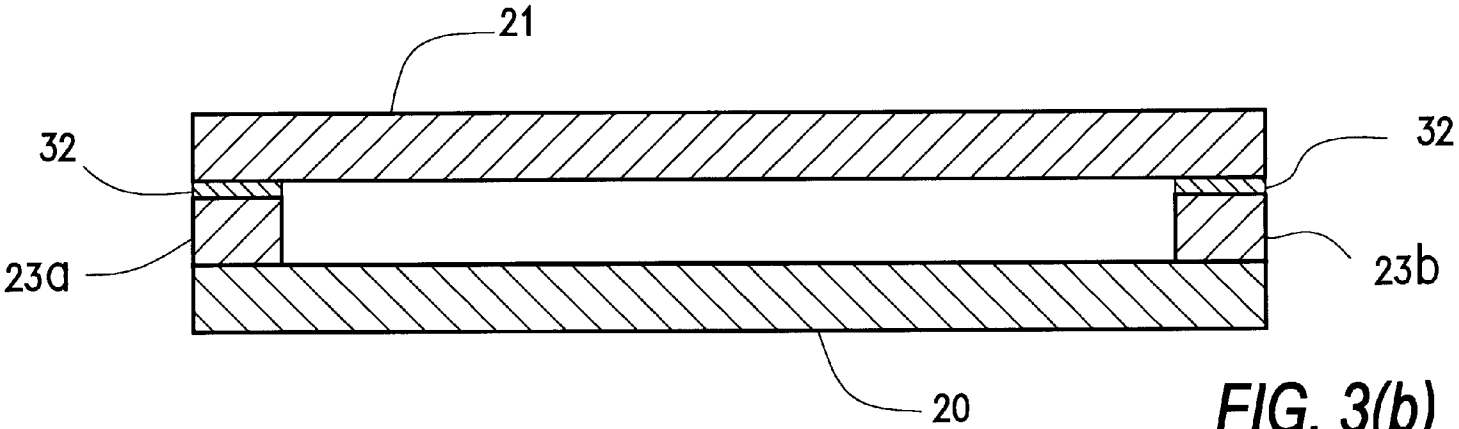
FIG. 3(b) PRIOR ART
Figure 4:
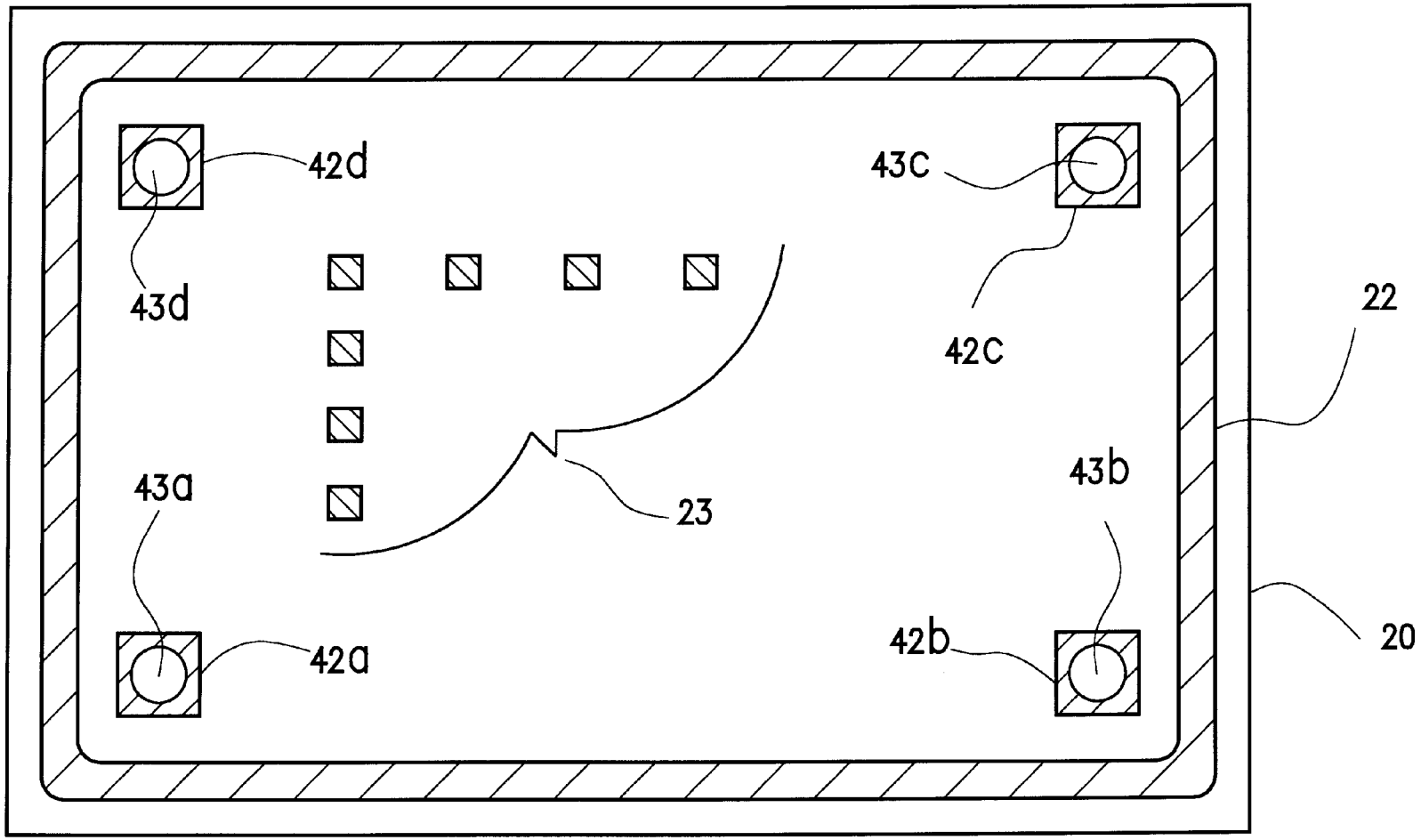
FIG. 4 illustrates a backside view of a faceplate formed in accordance with a first embodiment of the invention.

In accordance with a first embodiment of the present alignment process of the invention, FIG. 4 depicts a backside view of a faceplate 20 as used in the manufacturing of both field emission and plasma displays. Near the center of the faceplate is a plurality of spacers 23. As it is well known in the art, these spacers 23 are typically made of a glass material similar to that of the faceplate 20, and are employed to create an inherent gap between a faceplate and a baseplate after the sealing process which accommodates a vacuum or a quantity of rare gas for FEDs and plasma displays, respectively. The faceplate 20 is also shown as having a continuous strip of glass frit 22 disposed around the outer edges of faceplate 20. As is well known in the art, glass frits are used in the cathode ray tube and plasma display industries to seal glass together so as to form a high vacuum package. There are different types of frit which can be used for different types of glass and at different temperatures. The present alignment process of the invention is independent of the frit or glass type, or of the scaling method. As is also well known in art, disposing the glass frit on either the faceplate, as shown in FIG. 4, or the baseplate will result in an hermetic seal of equally good integrity.

In accordance with the present invention, at the four corners, and within the interior side of the continuous strip of glass frit 22, four pillars of glass frit 42*a*, 42*b*, 42*c*, 42*d* are disposed. Respectively disposed upon the top side of each of these discrete quantities of frit 42*a*, 42*b*, 42*c*, 42*d*, are discrete quantities of a sol-gel material 43*a*, 43*b*, 43*c*, 43*d*. As should be readily apparent, more or less than four pillars of glass frit may be used. Alternatively, these pillars may be placed outside the frit ring.

As is well known, a sol-gel material alternates between two states, one being a colloidal suspension of solid particles in a liquid, the other state being a dual phase material in which there is a solid outer shell filled with a solvent. When the solvent is removed, e.g., though exposure to ambient atmospheric pressure, a xerogel material results with a consistency similar to that of a low density glass.

As is also well known, a sol-gel material may be formulated by combining a quantity of potassium silicate (kasil) (e.g., 120 grams) with a comparatively smaller quantity of formamide (e.g., 7–8 grams). Alternatively, a lesser quantity of kasil (e.g., 12 grams) may be combined with still a lesser quantity of propylene carbonate (e.g., 2–3 grams). Another method of forming a sol-gel material involves the mixture of TEOS-$H_2O$ and methanol, and allowing the mixture to hydrolyse.

For purposes of the present invention, the sol-gel material used is in the gelatinous state; that is, the solvent-less state (e.g., in the xerogel state). For example, still referring to FIG. 4, before the sol-gel material completely cures, it is of a consistency similar to that of a highly viscous liquid (i.e., it flows to some degree). In accordance with the present invention, the more viscous the sol-gel material, the better; so long as it still flows so that it can be dispensed on top of the discrete frit pillars 42*a*, 42*b*, 42*c*, 42*d*.

Figure 5A:
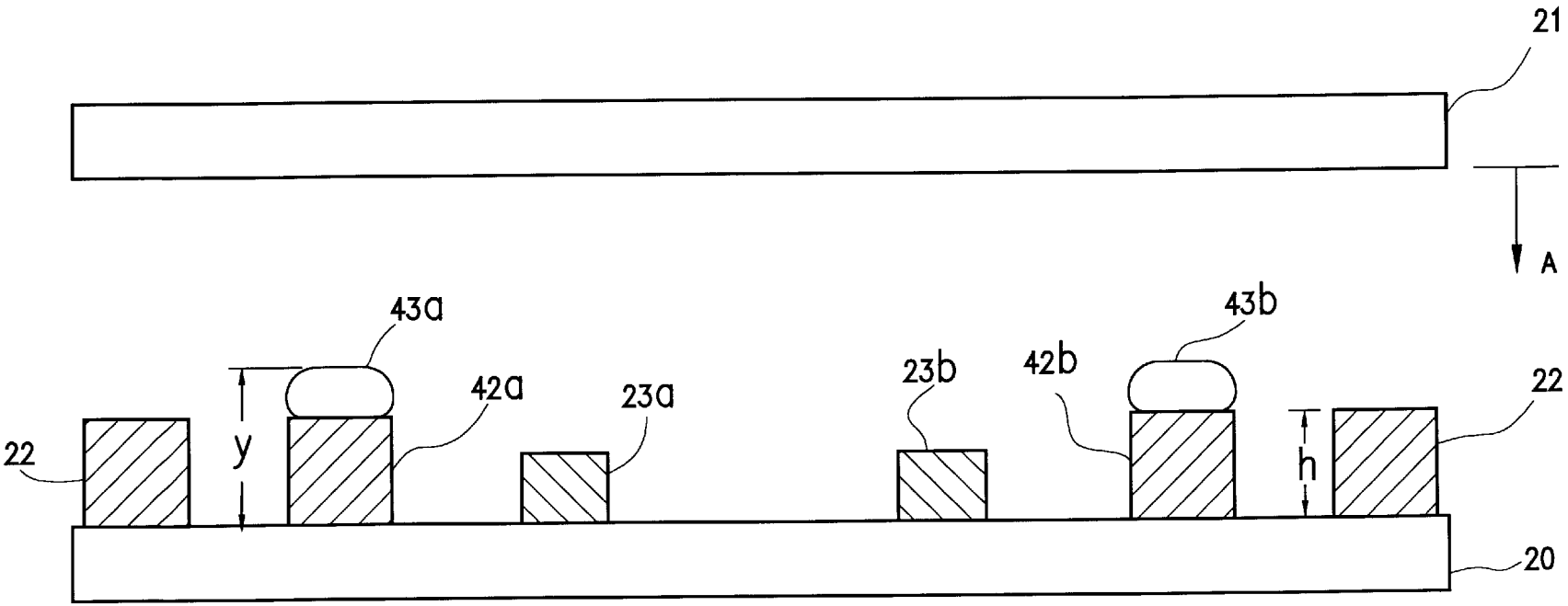
FIG. 5(*a*) illustrates a side view of the FIG. 4 faceplate in alignment with a baseplate in preparation for sealing.
Figure 5B:
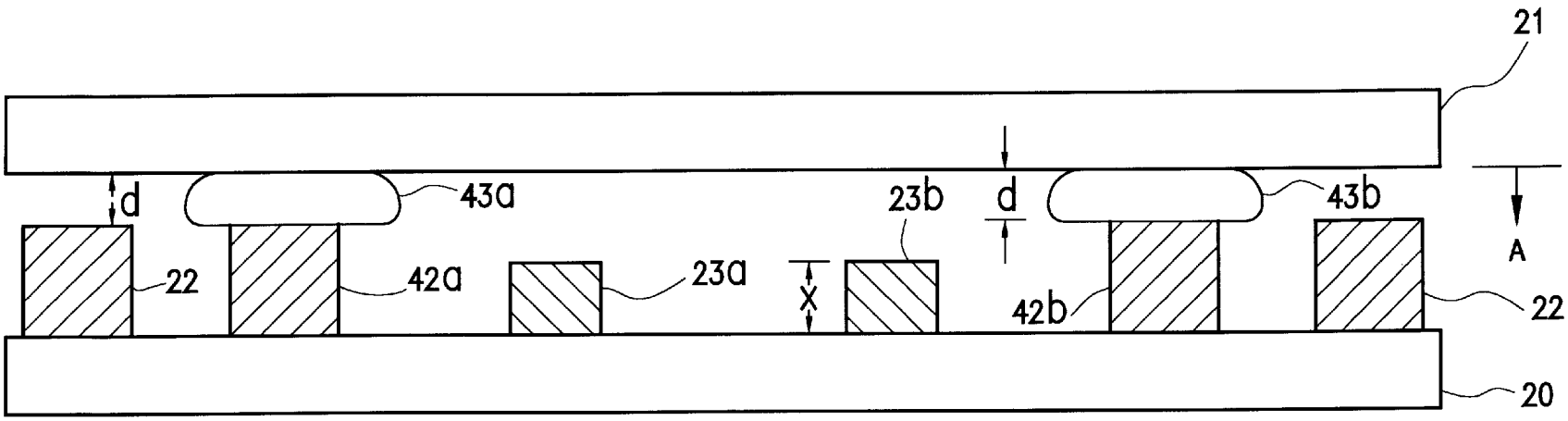
Figure 5C:
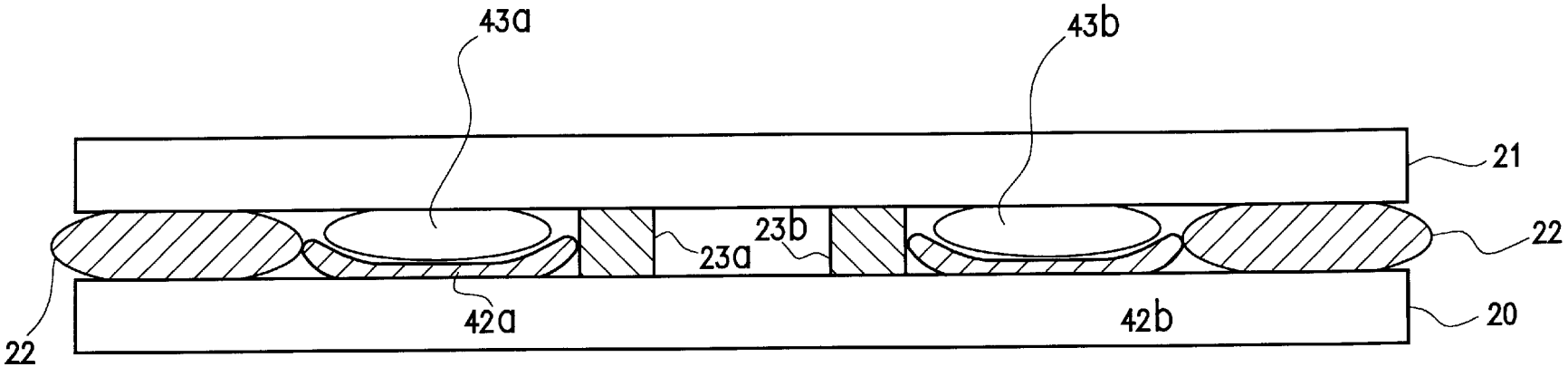

Referring now to FIG. 5(*a*), a side view of the faceplate 20 is shown to be in alignment with the baseplate 21. In this configuration, the positioning of both the faceplate 20 and the baseplate 21 are held in alignment with an alignment tool. The alignment tool maintains the plates 20, 21 in alignment while they are pressed together at the initial stages of the sealing process. In a typical manufacturing example, the baseplate 21 is moved in a direction A towards the faceplate 20 until the faceplate is in contact with the sol-gel material 43*a*, 43*b*. It should be apparent that, in the alternative, the faceplate 20 can be made to move in an opposite direction, toward baseplate 21. Additionally, it should be apparent that the combined height y of the glass frit 42*a*, 42*b* and the sol-gel material 43*a*, 43*b* must be greater than the height h of the continuous frit seal 22.

Referring now to FIG. 5(*b*), the next step in the sealing process is depicted. The baseplate 21 is in contact with the sol-gel material 43*a*, 43*b* while the alignment of faceplate 20 and baseplate 21 is still being maintained with an alignment tool. The height d of the sol-gel material 43*a*, 43*b*, atop the glass frit 42*a*, 42*b* must be less than the spacer height x, where x may be any value which provides a sufficient gap between faceplate 20 and baseplate 21 after seal. It is at this point in the manufacturing process that the sol-gel material 43*a,* 43*b* is permitted to cure. In accordance with the present invention, the sol-gel material 43*a,* 43*b* is typically cured for approximately one hour at ambient temperature and ambient atmospheric pressure. Alternatively, the curing process may be accelerated by other methods such as, e.g., applying heat to the alignment tool, or using an infrared heat source. In the case of the polycarbonate-kasil mixture, the sol-gel material 43*a,* 43*b* cures in approximately 5 to 10 minutes at room temperature. In either case, the alignment tool holds this intermediate panel assembly of the plates in alignment during the curing process. After the sol-gel material 43*a,* 43*b* has cured, the alignment tool may be removed from the assembly as the sol-gel material 43*a,* 43*b* will now hold the plates 20, 21 in alignment during the final stage of the sealing process.

The final stage of the sealing process is two-fold. First, the temperature of the assembly is increased to a value which will enable both the continuous glass frit seal 22, and the pillars of glass frit 42*a,* 42*b* to become less viscous. Typically, the temperature at which a frit will begin to become less viscous is between 100° C. and 500° C., dependent upon the frit composition. Second, while the glass frit 22, 42*a,* 42*b* softens due to the increased temperatures, its decreased viscosity enables the plates 20, 21 to be pressed further together; for example, by moving the baseplate 21 in the A direction until the baseplate 21 is in contact with the spacers 23*a,* 23*b.* In accordance with the present invention, the cured sol-gel material 43*a,* 43*b,* which softens at temperatures higher than that of the glass frit 22, 42*a,* 42*b,* remains solid and holds the plates 20, 21 in alignment by preventing them from shifting with respect to each other, thereby eliminating the need for an alignment tool.

Referring now to FIG. 5(*c*), the plates 20, 21 are shown in their final position as forming a panel assembly. As the temperature reaches a peak (e.g., of approximately 400° C.–500° C.), the plates 20, 21 are pressed further together until the baseplate 21 is separated from the faceplate 20 by only the spacers 23*a,* 23*b.* The resulting excess glass frit from both the continuous seal 22, and the pillars of glass frit 42*a,* 42*b,* is extruded from between the plates 20, 21, thereby forming a complete seal between the plates 20, 21. The assembly is then allowed to cool to room temperature. The result is an hermetic seal of solid glass with both plates 20, 21 in near perfect alignment, and without requiring an alignment tool for the final stages of sealing of plates 20, 21 with the seal 22.

Figure 6:
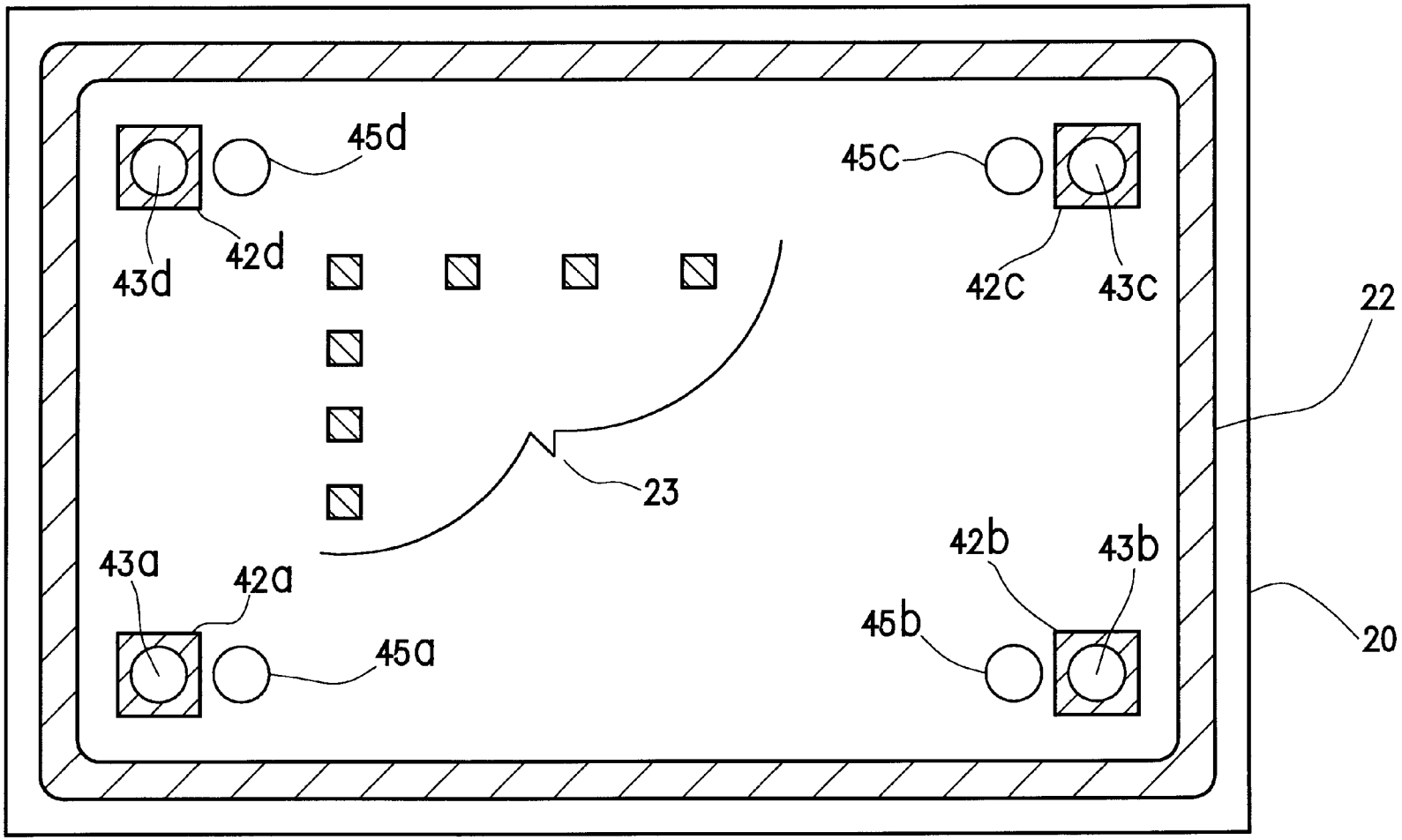
FIG. 6 illustrates the FIG. 4 backside view of a faceplate formed in accordance with a second embodiment of the invention.

FIG. 6 depicts a backside view of a faceplate 20, in accordance with a second embodiment of the invention. The FIG. 6 faceplate 20 differs from the FIG. 4 faceplate 20 in that it has four additional pillars of an adhesive material 45*a,* 45*b,* 45*c,* 45*d* disposed near each corner, and also near each pillar of glass frit material 42*a,* 42*b,* 42*c,* 42*d.* In this embodiment, the adhesive material is indium, however, any other material which serves the same purpose, as described below, may be substituted without deviating from the scope of the present invention.

Figure 7A:
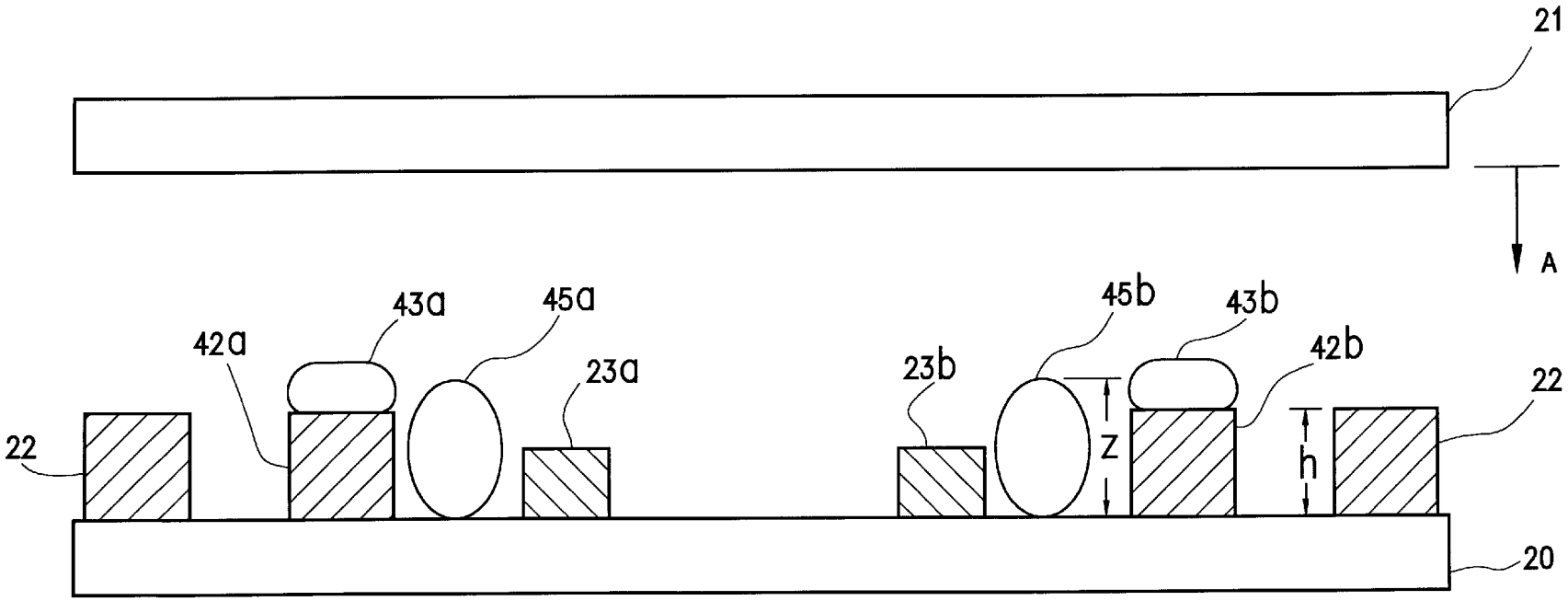
FIG. 7(*a*) illustrates a side view of the FIG. 6 faceplate in alignment with a baseplate in preparation for sealing.
Figure 7B:
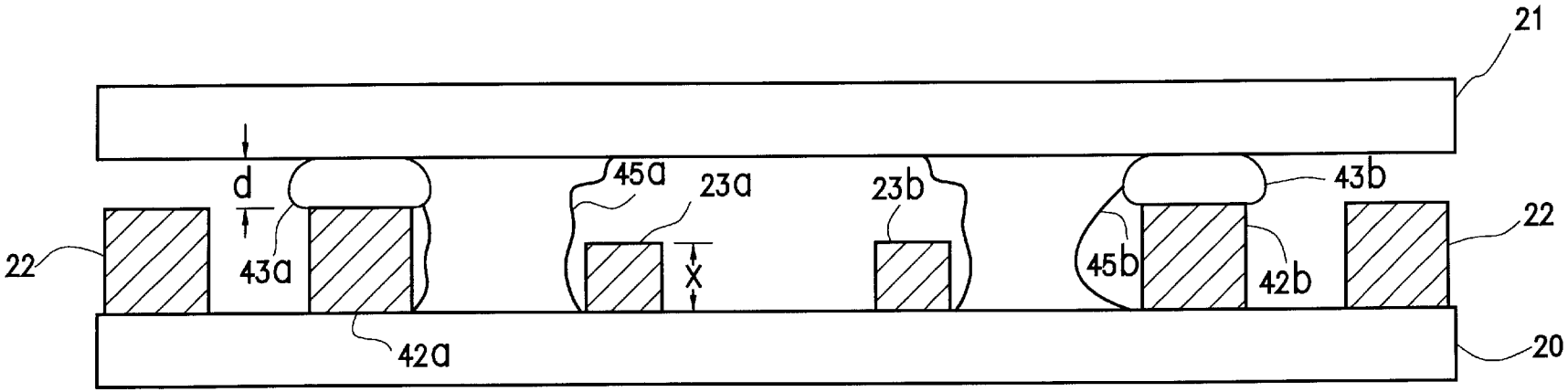
Figure 7C:
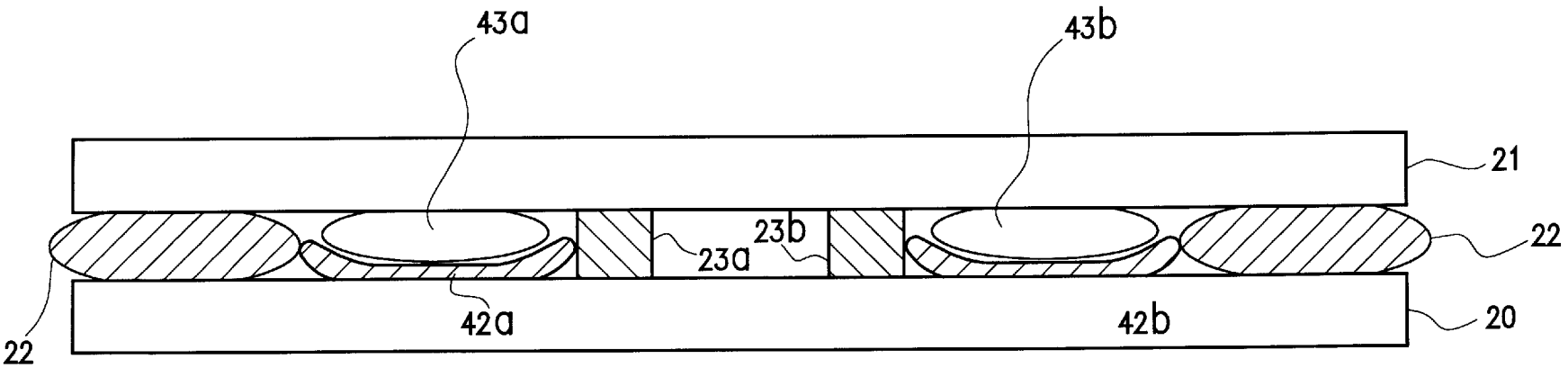

Referring now to FIG. 7(*a*), a side view of the FIG. 6 faceplate 20 is shown to be in alignment with the baseplate 21. FIG. 7(*a*) depicts a side view of the faceplate 20 and baseplate 21 and includes the additional pillars of adhesive material 45*a,* 45*b.* As shown, the height z of the adhesive deposit 45*a,* 45*b* is greater than the height h of the continuous frit seal 22.

Referring now to FIG. 7(*b*), the next step in the sealing process is depicted. As shown, the baseplate 21 is now in contact with both the sol-gel material 43*a,* 43*b,* atop the glass frit deposits 42*a,* 42*b,* and also the pillars of adhesive material 45*a,* 45*b.* The height d of the sol-gel deposits 43*a,* 43*b* is less than the spacer height x. The sol-gel material is again allowed to cure and affix the faceplate 20 and baseplate 21.

The adhesive material 45*a,* 45*b,* maintains the plates 20, 21 in alignment during the initial stages of the sealing process. The combination of the sol-gel material 43*a,* 43*b,* and the indium deposits 45*a,* 45*b,* enable handling of the FIG. 7(*b*) structure and the final assembly of the plates 20, 21 without the use of an alignment tool. That is to say, the adhesive material 45*a,* 45*b* is used to quickly tack the plates 20, 21 together in an intermediate panel assembly while the sol-gel material 43*a,* 43*b* cures and thereafter the sol-gel maintains the alignment of plates 20,21.

FIG. 7(*c*) shows the final steps of the assembly process. As the temperature of the assembly is increased (e.g., above 100° C.), as is required to soften the glass frit 22, 42*a,* 42*b,* the adhesive material 45*a,* 45*b* (of FIG. 7(*b*)) will become liquid. That is to say, as the temperature increases, the assembly relies less upon the adhesive material for alignment and more upon the now cured sol-gel material. The plates 20, 21 are shown in their final positions in FIG. 7(*c*). As the temperature reaches a peak (e.g., of approximately 400° C.–500° C.), the plates 20, 21 are pressed further together until the baseplate 21 is separated from the faceplate 20 by only the spacers 23*a,* 23*b.* The resulting excess glass frit from both the continuous seal 22, and the pillars of frit 42*a,* 42*b,* is extruded from between the plates 20, 21, thereby forming a complete seal between the plates 20, 21. The assembly is then allowed to cool to room temperature. The result is an hermetically sealed panel assembly with both plates 20, 21 in near perfect alignment, and without requiring an alignment tool for the final stages of sealing of plates 20, 21 with the seal 22.

Figure 8:
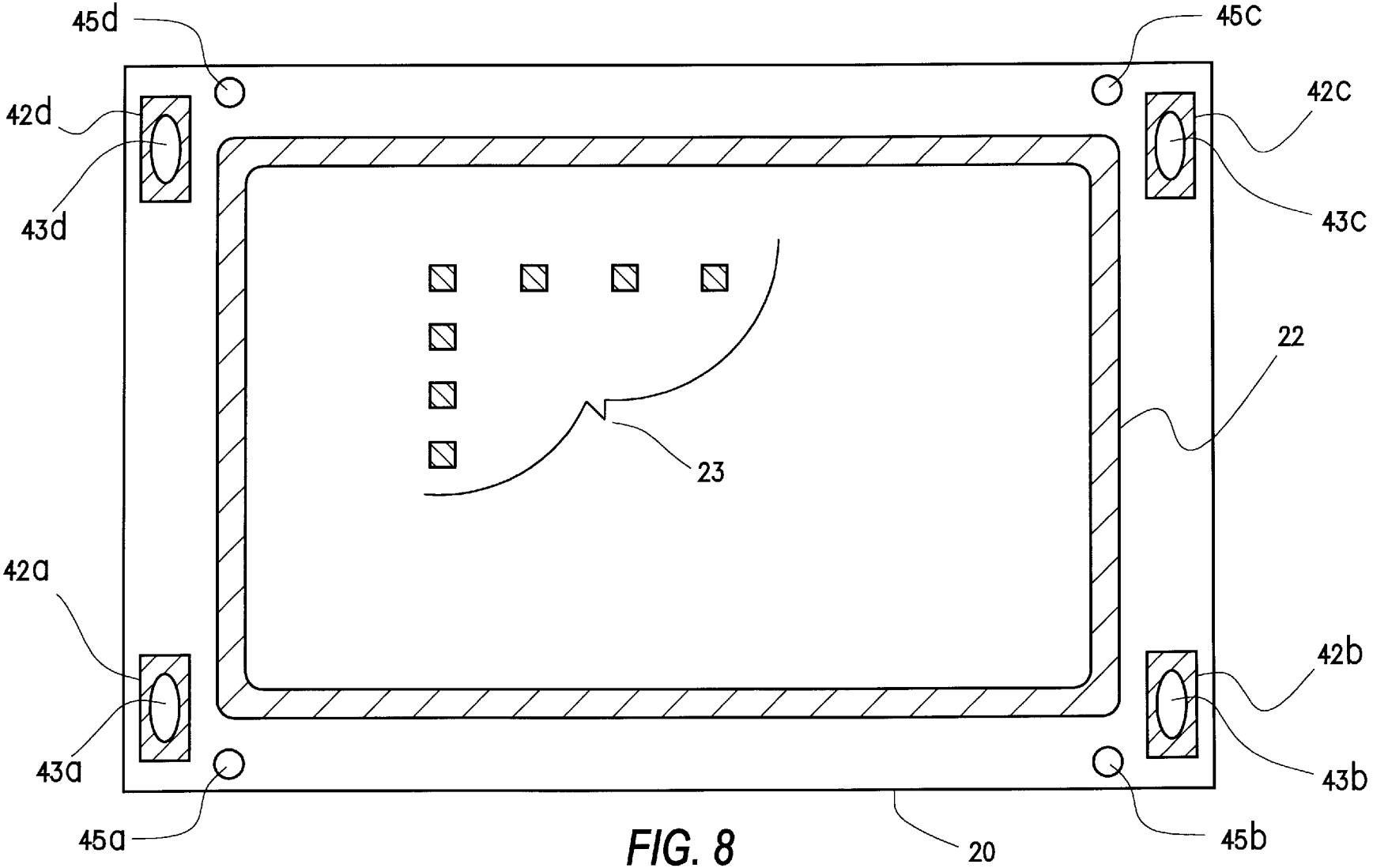
FIG. 8 illustrates a backside view of a faceplate formed in accordance with a third embodiment of the invention.

FIG. 8 shows a third embodiment of the invention in which the sol-gel material 43*a,* 43*b,* 43*c,* 43*d,* disposed atop the pillars of glass frit 42*a,* 42*b,* 42*c,* 42*d,* is located outside the continuous frit seal 22 and is, therefore, outside the plate gap. In many instances, this embodiment provides superior results since the sol-gel material 43*a,* 43*b,* 43*c,* 43*d* may, during curing and/or heating, give off contaminants which might adversely affect the cathode member if such contaminants cannot be fully evacuated from between the plates 20, 21. Placing the sol-gel material outside the glass frit seal 22 in this manner better ensures that any such contaminants will be pumped out from between the plates 20, 21 during a subsequent vacuum process. In every other aspect, the assembly of a display panel using the FIG. 8 embodiment follows the same steps as described above with respect to FIGS. 7(*a*), 7(*b*), and 7(*c*).

Figure 9:
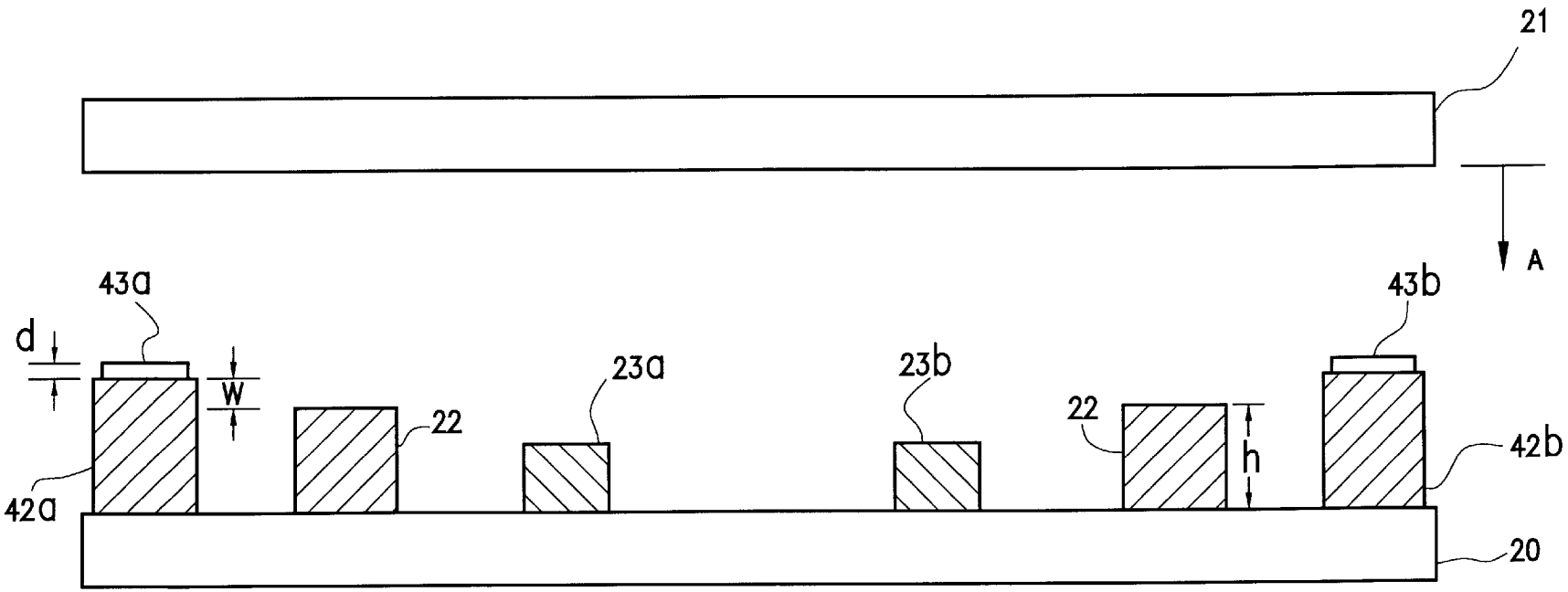
FIG. 9 illustrates a side view of the FIG. 8 faceplate in alignment with a baseplate in preparation for sealing.

Turning now to FIG. 9, an alternative method of ensuring that the baseplate 21 does not contact the frit seal 22 while the sol-gel material 43*a,* 43*b,* 43*c,* 43*d* maintains the plates 20, 21 in alignment is depicted. As will be described more fully below, this embodiment is preferred when only a very thin film d (e.g. <10 $\mu$m) of sol-gel material 43*a,* 43*b* is disposed on top of each glass frit pillar 42*a,* 42*b.*

Baseplate 21 should not make contact with frit seal 22 while the plates 20, 21 are in alignment because such contact would eliminate, or at the very least greatly reduce, the conductive path required to evacuate the air from between the plates 20, 21 during a subsequent vacuum operation. In order to ensure that such contact is not made when very thin layers d of sol-gel material 43*a,* 43*b* have been disposed, the height of the glass frit pillars 42*a,* 42*b* must exceed the height of the frit seal 22 by a value of w, where w is approximately 10–500 μm. This method ensures a minimum of approximately 10 μm spacing between the frit seal 22 and the baseplate 21 is available for a conductive path.

An advantage of the present invention is the high degree of panel assembly manufacturing accuracy which is achieved without adding additional manufacturing steps. The plates 20, 21 can be successfully held within an alignment accuracy of +/−5 μm, for a 12 inch display, without an alignment tool, by the use of a sol-gel material to temporarily hold the assembly together. Furthermore, increased manufacturing throughput can also be easily realized with the addition of a simple adhesive to the assembly.

While preferred embodiments of the invention have been described and illustrated, it should be apparent that many modifications can be made to the invention without departing from its spirit or scope. For example, other types of vacuum compatible sol-gels, and frit materials than those described herein, may be utilized to practice the present alignment method of the invention. Accordingly, the invention is not limited by the foregoing description or drawings, but is only limited by the scope of the appended claims.

What is claimed as new and desired to be protected by Letters Patent of the United States is:

1. A method for sustaining an alignment of two complementary glass plates which are to be bonded together, said method comprising:

disposing a first glass frit material on at least one of said two plates;

disposing a sol-gel material on top of said glass frit material;

positioning said plates in a parallel spaced apart relationship and in alignment with one another with said first glass flit material and sol-gel material between them;

moving at least one of said plates toward the other while maintaining said alignment until the other of said plates is in contact with said sol-gel material forming an intermediate assembly; and curing said sol-gel material to hold said plates in an aligned state in said intermediate assembly.

2. The method as in claim 1 further comprising:

processing said intermediate assembly by:

increasing a temperature level of said intermediate assembly to soften said first glass frit material; and moving at least one of said plates toward the other to engage a seal for said plates and until at least one spacer, provided between said plates, prevents further movement of said sealed plates toward each other to produce a panel assembly.

3. The method as in claim 2, wherein said seal is formed by a glass frit and said seal is formed by:

disposing a second substantially continuous glass frit material on a surface of one of said plates adjacent to an outer edge thereof;

softening said second substantially continuous glass frit material when said first glass frit material is softened; and squeezing said second substantially continuous glass frit material between said plates to form a seal between said plates in said panel.

4. The method as in claim 3, wherein said seal is an hermetic seal.

5. The method as in claim 2, wherein said seal is formed by a glass frit and said seal is formed by:

disposing a second substantially continuous glass frit material on a surface of one of said plates;

softening said second substantially continuous glass frit material when said first glass frit material is softened; and squeezing said second substantially continuous glass frit material between said plates to form a seal between said plates in said panel.

6. The method as in claim 5, wherein said seal is an hermetic seal.

7. The method as in claim 2, wherein at least one of said plates contains said at least one spacer.

8. The method as in claim 2, wherein said act of increasing comprises increasing said temperature level to approximately 450° C.

9. The method as in claim 2, wherein said act of moving at least one of said plates toward the other results in an extrusion of an excess quantity of said glass frit material from between said plates.

10. The method as in claim 1, wherein said panel assembly forms a field emission display.

11. The method as in claim 1, wherein said panel assembly forms a plasma display.

12. The method as in claim 1, wherein said glass frit material is disposed near an outer edge of said first plate.

13. The method as in claim 1 further comprising:

disposing at least one pillar of said glass frit material on at least a first one of said two glass plates; and disposing a sol-gel material on top of said at least one pillar of glass frit.

14. The method as in claim 13 further comprising:

disposing at least one pillar of an adhesive material on said at least a first plate, and wherein;

said act of moving at least one of said plates toward the other further comprises moving said at least one plate until the other of said plates is in contact with said adhesive material to hold said plates together and then further moving at least one plate until the other of said plates is in contact with said sol-gel material.

15. The method as in claim 1, wherein said act of moving at least one of said plates toward the other further comprises moving one of said plates in a direction towards the other of said plates while said plates are maintained in alignment.

16. The method as in claim 1, wherein said act of curing further comprises increasing a temperature level of said sol-gel material.

17. The method as in claim 1, wherein said act of curing further comprises exposing said sol-gel material to infrared light.

18. A method for sustaining an alignment of two complimentary glass plates as used in the manufacturing of field emission displays and/or plasma displays, the method comprising:

disposing a first glass frit material on at least one of said two plates;

disposing a sol-gel material on top of said glass frit material;

positioning said plates in a parallel spaced apart relationship and in alignment with one another with said first glass frit material and sol-gel material between them;

moving at least one of said plates toward the other while maintaining said alignment until the other of said plates is in contact with said sol-gel material forming an intermediate assembly; and curing said sol-gel material to hold said plates in an aligned state in said intermediate assembly.

19. The method as in claim 18 further comprising:

processing said intermediate assembly by:

increasing a temperature level of said intermediate assembly to soften said first glass frit material; and moving at least one of said plates toward the other to engage a seal for said plates and until at least one spacer, provided between said plates, prevents further movement of said sealed plates toward each other to produce a panel assembly.

20. The method as in claim 19, wherein said seal is formed by a glass frit and said seal is formed by:

disposing a second substantially continuous glass frit material on a surface of one of said plates adjacent to an outer edge thereof;

softening said second substantially continuous glass frit material when said first glass frit material is softened; and squeezing said second substantially continuous glass frit material between said plates to form a seal between said plates in said panel.

21. The method as in claim 20, wherein said seal is an hermetic seal.

22. The method as in claim 19, wherein said seal is formed by a glass frit and said seal is formed by:

disposing a second substantially continuous frit material on a surface of one of said plates;

softening said second substantially continuous glass frit material when said first glass frit material is softened; and squeezing said second substantially continuous glass frit material between said plates to form a seal between said plates in said panel.

23. The method as in claim 22, wherein said seal is an hermetic seal.

24. The method as in claim 19, wherein said act of increasing further comprises increasing said temperature level to approximately 450° C.

25. The method as in claim 19, wherein said act of moving at least one of said plates toward the other results in an extrusion of an excess quantity of said glass frit material from between said plates.

26. The method as in claim 18, wherein one of said plates is a faceplate.

27. The method as in claim 18, wherein one of said plates is a cathode member.

28. The method as in claim 18, wherein said glass frit material is disposed near an outer edge of said first plate.

29. The method as in claim 18 further comprising:

disposing at least one pillar of said glass frit material on at least a first one of said two glass plates; and disposing a sol-gel material on top of said at least one pillar of glass frit.

30. The method as in claim 29, wherein said sol-gel material further comprises a xerogel material.

31. The method as in claim 29 further comprising disposing at least one pillar of an adhesive material on said at least a first plate.

32. The method as in claim 31, wherein said adhesive material is disposed within close proximity to said at least one pillar of said glass frit material.

33. The method as in claim 31, wherein said adhesive material is further comprised of indium.

34. The method as in claim 31, wherein said act of moving at least one of said plates toward the other further comprises moving said at least one plate until the other of said plates is in contact with said adhesive material to hold said plates together and then further moving at least one plate until the other of said plates is in contact with said sol-gel material.

35. The method as in claim 34, wherein said adhesive material maintains said plates in said aligned state in said intermediate assembly.

36. The method as in claim 35, wherein said adhesive material evaporates as a temperature level of said intermediate assembly is increased.

37. The method as in claim 18, wherein said act of moving at least one of said plates toward the other further comprises moving one of said plates in a direction towards the other of said plates while said plates are maintained in alignment.

38. The method as in claim 18, wherein said act of curing further comprises increasing a temperature level of said sol-gel material.

39. The method as in claim 18, wherein said act of curing further comprises exposing said sol-gel material to infrared light.

40. An intermediate panel assembly created in connection with bonding two complementary glass plates comprising:

a first glass plate;

a first glass frit material in physical contact with a first side of said first glass plate;

a sol-gel material in physical contact with a side of said first glass frit material which is opposite a side in physical contact with said first glass plate; and a second glass plate in a parallel relationship with, and in alignment with, said first plate, a first side of said second glass plate being in physical contact with said sol-gel material.

41. The assembly as in claim 40, wherein said sol-gel material is in a cured state.

42. The assembly as in claim 40, wherein said intermediate panel assembly is created in connection with manufacturing a field emission display.

43. The assembly as in claim 40, wherein said intermediate panel assembly is created in connection with manufacturing a plasma display.

44. The assembly as in claim 40, wherein said first glass frit material is within close proximity to an outer edge of said first side of said first glass plate.

45. The assembly as in claim 44 further comprising a second substantially continuous glass frit material in physical contact with said first side of said first glass plate.

46. The assembly as in claim 45, wherein said second substantially continuous glass frit material is located adjacent to an outer edge of said first glass plate.

47. The assembly as in claim 45 further comprising:

at least one pillar of glass frit material in physical contact with said first side of said first plate; and a sol-gel material in physical contact with a side of said pillar of glass frit which is opposite the side in physical contact with said first plate, said sol-gel material also being in physical contact with said first side of said second plate.

48. The assembly as in claim 47 further comprising at least one pillar of an adhesive material in physical contact with said first side of said first plate, said at least one pillar of adhesive material also being in physical contact with said first side of said second plate.

49. The assembly as in claim 40, further comprising at least one spacer which is in physical contact with at least one of said first and said second plates, said spacer also being located between both of said plates.

50. An intermediate panel assembly created in connection with the manufacturing of field emission displays and/or plasma displays comprising:

a first glass plate;

a first glass frit material in physical contact with a first side of said first glass plate;

a sol-gel material in physical contact with a side of said first glass frit material which is opposite a side in physical contact with said first glass plate; and a second glass plate in a parallel relationship with, and in alignment with, said first plate, a first side of said second glass plate being in physical contact with said sol-gel material.

51. The assembly as in claim 50, wherein said sol-gel material is in a cured state.

52. The assembly as in claim 50, wherein one of said plates is a faceplate.

53. The assembly as in claim 50, wherein one of said plates is a cathode member.

54. The assembly as in claim 50, wherein said first glass frit material is within close proximity to an outer edge of said first side of said first glass plate.

55. The assembly as in claim 54 further comprising a second substantially continuous glass frit material in physical contact with said first side of said first glass plate.

56. The assembly as in claim 55, wherein said second substantially continuous glass frit material is located adjacent to an outer edge of said first glass plate.

57. The assembly as in claim 55 further comprising:

at least one pillar of glass frit material in physical contact with said first side of said first plate; and a sol-gel material in physical contact with a side of said pillar of glass frit which is opposite the side in physical contact with said first plate, said sol-gel material also being in physical contact with said first side of said second plate.

58. The assembly as in claim 57, wherein said sol-gel material further comprises a xerogel material.

59. The assembly as in claim 57 further comprising at least one pillar of an adhesive material in physical contact with said first side of said first plate.

60. The assembly as in claim 59, wherein said adhesive material is located within close proximity to said at least one pillar of glass frit material.

61. The assembly as in claim 59, wherein said adhesive material is further comprised of indium.

62. The assembly as in claim 59, wherein said adhesive material is in physical contact with said first side of said second plate.

63. The assembly as in claim 57, wherein a height of said at least one pillar of glass frit material exceeds a height of said second substantially continuous glass frit material.

* * * * *

UNITED STATES PATENT AND TRADEMARK OFFICE

CERTIFICATE OF CORRECTION

PATENT NO. : 6,030,267
DATED : February 29, 2000
INVENTOR(S) : Jim J. Browning

It is certified that error appears in the above-identified patent and that said Letters Patent is hereby corrected as shown below:

Title page,

-- (*) Notice: GOVERNMENT RIGHTS
This invention was made with United States Government support under contract No. DABT63-97-C-0001 awarded by the Advance Research Projects Agency (ARPA). The United States Government has certain rights in this invention. --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*